US005816090A

United States Patent [19]

Hodge et al.

[11] Patent Number: 5,816,090

[45] Date of Patent: Oct. 6, 1998

[54] METHOD FOR PNEUMATIC ISOSTATIC PROCESSING OF A WORKPIECE

[75] Inventors: Edwin S. Hodge, Ocala, Fla.; Robert F. Tavenner, Crossville, Tenn.

[73] Assignee: Ametek Specialty Metal Products Division, Wallingford, Conn.

[21] Appl. No.: 941,709

[22] Filed: Sep. 30, 1997

Related U.S. Application Data

[63] Continuation-in-part of Ser. No. 924,540, Aug. 27, 1997, abandoned, which is a continuation of Ser. No. 570,393, Dec. 11, 1995, abandoned.

[51] Int. Cl.[6] ..... B21D 26/02; B21J 5/03

[52] U.S. Cl. ..... 72/56; 266/255; 432/205

[58] Field of Search ..... 72/364, 56, 54; 266/249, 255, 257; 432/205, 203, 82

[56] References Cited

U.S. PATENT DOCUMENTS

| | | |
|---|---|---|
| 2,878,140 | 3/1959 | Barr . |
| 3,279,917 | 10/1966 | Ballard et al. . |
| 3,284,195 | 11/1966 | Googin et al. . |
| 3,363,037 | 1/1968 | Levey, Jr. et al. . |
| 3,419,935 | 1/1969 | Pfeiler et al. . |
| 3,562,371 | 2/1971 | Bush . |
| 3,571,850 | 3/1971 | Pohto et al. . |
| 3,577,635 | 5/1971 | Bergman et al. . |
| 3,748,196 | 7/1973 | Kemeny . |
| 3,765,958 | 10/1973 | Freche et al. . |
| 4,359,336 | 11/1982 | Bowles . |
| 4,431,605 | 2/1984 | Lueth . |
| 4,435,213 | 3/1984 | Hildeman et al. . |
| 4,518,441 | 5/1985 | Hailey . |
| 4,564,501 | 1/1986 | Goldstein . |
| 4,582,681 | 4/1986 | Asari et al. . |
| 4,591,482 | 5/1986 | Nyce . |
| 4,601,877 | 7/1986 | Fujii et al. . |
| 4,612,162 | 9/1986 | Morgan et al. . |
| 4,615,745 | 10/1986 | Goransson et al. . |
| 4,684,405 | 8/1987 | Kolaska et al. . |
| 4,743,312 | 5/1988 | Eridon et al. . |
| 4,744,943 | 5/1988 | Timm . |
| 4,810,289 | 3/1989 | Hoyer et al. . |
| 4,856,311 | 8/1989 | Conaway . |
| 4,921,666 | 5/1990 | Ishii . |
| 4,942,750 | 7/1990 | Conaway . |
| 4,961,778 | 10/1990 | Pyzik et al. . |
| 5,009,842 | 4/1991 | Hendrickson et al. . |
| 5,080,841 | 1/1992 | Nishio . |
| 5,110,542 | 5/1992 | Conaway . |
| 5,269,830 | 12/1993 | Rabin et al. . |
| 5,445,787 | 8/1995 | Friedman et al. . |
| 5,561,834 | 10/1996 | Score . |

*Primary Examiner*—John Sipos
*Assistant Examiner*—John Paradiso
*Attorney, Agent, or Firm*—Bachman & LaPointe, P.C.

[57] ABSTRACT

A pneumatic isostatic forging process for densification of near net shape workpieces is disclosed. In the process, a workpiece is heated prior to the forging process, such as from a previous processing step. The workpiece is loaded into a pressure vessel. The pressure in the vessel is ramped to an operating pressure and held for approximately 10–120 seconds. The vessel is pressurized using rapid pressurization to achieve a high strain rate to assist in the final closure of voids within the workpiece, with the increase in the strain rate lowering the flow stress requirements for the workpiece, thereby making the workpiece more susceptible to plastic deformation. The rapid pressurization serves to densify the gas within the vessel, thereby increasing the viscosity of the gas in order to substantially reduce or altogether prevent absorption of the gas into the workpiece in order to sustain a differential between the internal pressure and the surface pressure of the workpiece, thereby allowing plastic deformation to take place through a collapsing of the material, or removal of the voids. After pressurization of the vessel for a prescribed period of time, it is depressurized and the workpiece is unloaded.

49 Claims, 1 Drawing Sheet

METHOD FOR PNEUMATIC ISOSTATIC PROCESSING OF A WORKPIECE

CROSS-REFERENCE TO RELATED APPLICATIONS

This application is a continuation-in-part of U.S. Ser. No. 08/924,540, filed Aug. 27, 1997, abandoned, to a METHOD FOR PNEUMATIC ISOSTATIC PROCESSING OF A WORKPIECE by Hodge et al., which is a continuation of U.S. Ser. No. 08/570,393, filed Dec. 11, 1995, abandoned to a METHOD FOR PNEUMATIC ISOSTATIC PROCESSING OF A WORKPIECE by Hodge et al. This application is also related to U.S. Ser. No. 08/417,936, filed Apr. 6, 1995, now abandoned.

BACKGROUND OF THE INVENTION

1. Technical Field

The present invention relates to the field of high pressure processing of materials and more specifically to the use of isostatic pressure in combination with high temperatures to densify materials and to form near net shape products. More specifically, this invention relates to a method for processing a workpiece using pneumatic isostatic forging techniques in-line with a conventional manufacturing process.

2. Prior Art

Conventional hot isostatic pressing (HIP) has been utilized to compact and/or densify powders, ceramics, composites and metal powder components. Conventional HIP processes generally combine high heat and isostatic pressure to compact and/or densify a particular workpiece. Significant drawbacks to HIP processes include at least the following: (1) the workpiece must be held at elevated temperatures and pressures for an extended amount of time; (2) the workpieces must occupy the HIP press for extended amounts of time thereby reducing throughput and increasing processing costs; and (3) in most cases, the final void closure is by creep and/or diffusion rather than plastic deformation resulting from stress. Further, HIP processes, as well as other compaction processes, are performed on workpieces after manufacture of the same. Thus, two separate processes are required to achieve a densified workpiece using conventional techniques.

Methods and devices typically of the art are disclosed in the following U.S. patents:

| U.S. Pat. No. | Inventor(s) | Issue Date |
|---|---|---|
| 2,878,140 | H. N. Barr | March 17, 1959 |
| 3,184,224 | D. P. Shelley | May 18, 1965 |
| 3,279,917 | A. H. Ballard et al. | October 18, 1966 |
| 3,284,195 | J. M. Googin et al. | November 8, 1966 |
| 3,363,037 | R. P. Levey, Jr. et al. | January 9, 1968 |
| 3,419,935 | W. A. Pfeiler et al. | January 7, 1969 |
| 3,562,371 | E. A. Bush | February 9, 1971 |
| 3,571,850 | H. A. Pohto | March 23, 1971 |
| 3,577,635 | C. Bergman | May 4, 1971 |
| 3,748,196 | G. A. Kemeny | July 24, 1973 |
| 4,245,818 | F. W. Elhaus et al. | January 20, 1981 |
| 4,359,336 | A. G. Bowles | November 16, 1982 |
| 4,388,054 | H. G. Larsson | June 14, 1983 |
| 4,431,605 | R. C. Lueth | February 14, 1984 |
| 4,435,360 | J. P. Trottier et al. | March 6, 1984 |
| 4,480,882 | L. Mauratelli | November 6, 1984 |
| 4,564,501 | D. Goldstein | January 14, 1986 |
| 4,582,681 | A. Asari et al. | April 15, 1986 |
| 4,591,482 | A. C. Nyce | May 27, 1986 |

-continued

| U.S. Pat. No. | Inventor(s) | Issue Date |
|---|---|---|
| 4,601,877 | T. Fujii et al. | July 22, 1986 |
| 4,612,162 | R. D. Morgan et al. | September 16, 1986 |
| 4,615,745 | Goransson et al. | October 7, 1986 |
| 4,616,499 | R. M. Gray | October 14, 1986 |
| 4,684,405 | J. Kolaska et al. | August 4, 1987 |
| 4,704,252 | G. D. Pfaffmann | November 3, 1987 |
| 4,710,345 | Y. Doi et al. | December 1, 1987 |
| 4,744,943 | E. E. Timm | May 17, 1988 |
| 4,756,680 | T. Ishii | July 12, 1988 |
| 4,810,289 | N. S. Hoger et al. | March 7, 1989 |
| 4,836,978 | R. Watanabe et al. | June 6, 1989 |
| 4,856,311 | R. M. Conaway | August 15, 1989 |
| 4,921,666 | T. Ishii | May 1, 1990 |
| 4,931,238 | H. Nishio et al. | June 5, 1990 |
| 4,942,750 | R. M. Conaway | July 24, 1990 |
| 4,981,528 | L. G. Fritzemeier et al. | January 1, 1991 |
| 5,032,353 | W. Smarsly et al. | July 16, 1991 |
| 5,041,261 | S. T. Buljan et al. | August 20, 1991 |
| 5,069,618 | J. L. Nieberding | December 3, 1991 |
| 5,080,841 | H. Nishio | January 14, 1992 |
| 5,110,542 | R. M. Conaway | May 5, 1992 |
| 5,118,289 | C. Bergman et al. | June 2, 1992 |
| 5,174,952 | P. Jongenburger et al. | December 29, 1992 |
| 5,445,787 | I. Friedman et al. | August 29, 1995 |

Earlier methods focused on the use of pressure transfer media to insure the isostatic application of pressure to a workpiece. The devices developed early on were highly complex. Recently, many methods and devices have been developed in an attempt to solve the problems of the conventional HIP processes. "Quick-HIP" or "Fast-HIP" processes have been developed which achieve the isostatic pressing with a significant decrease in processing time. The "Fast-HIP" or "Quick-HIP" process is accomplished via thermal expansion of gases to generate elevated pressures. However, these processes do not allow for independent control over the temperature and pressure.

Of these patents, that issued to Ishii ('666) discloses a HIP process wherein the workpiece is initially heated external to the pressure vessel. However, once the workpiece is transferred to the pressure vessel, both the temperature and the pressure are increased. In order to accomplish this, both the workpiece and the heating chamber are introduced into the pressure vessel. While Ishii teaches a means for reducing the pre-heating and cool-down times, the time required for pressurizing the workpiece is unchanged from traditional HIP processes. As is well known in the art, HIP processes densify workpieces through creep and diffusion, which are indicative of a low strain rate process.

U.S. Pat. No. 5,110,542 discloses a device for rapid densification of materials which utilizes heat elements to increase the pressure within the pressure vessel and separate heating elements to raise the temperature of the workpiece. The rapidity at which the workpiece is heated and subsequently cooled is limited by the constraints of what the equipment will practically allow. Also, the useable capacity of the device is limited by the use of two chambers and an internal furnace. Further, the times for loading and unloading the workpiece are greater than the cycling times.

SUMMARY OF THE INVENTION

Accordingly, it is an object of the present invention to provide a method for densifying a workpiece which produces a net or near net shape product.

It is a further object of the present invention to provide a method as above in which the mechanism of consolidation is high strain rate, plastic deformation.

It is yet a further object of the present invention to provide a method as above which allows densification of a workpiece in a relatively short time period.

It is still another object of the present invention to provide a method as above which may be used with a wide variety of workpiece materials including but not limited to powdered materials and castings.

Another object of the present invention is to provide a method as above whereby a workpiece is densified within a pressure vessel configured such that a substantial portion of the chamber therein is occupied by the workpiece.

The foregoing objects are attained by the method of the present invention.

In accordance with the present invention, a method for densifying a workpiece so as to produce a near net shape final product comprises the steps of: providing a workpiece and a pressure vessel for processing the workpiece; heating the workpiece externally of the pressure vessel to a temperature at which the workpiece can be forged; transferring the workpiece to the pressure vessel while the workpiece is at the temperature; and applying pressure to the workpiece without any further application of heat and at a rate sufficient to close voids in the workpiece by plastic deformation. The pressure applying step involves introducing a gaseous medium, such as argon, nitrogen, or mixtures thereof, under pressure into the pressure vessel. The gaseous medium acts as a gas hammer to rapidly transfer energy to form the workpiece.

In one alternative of the method of the present invention, a coating is applied to the surfaces of the workpiece prior to the heating step. In another alternative of the method of the present invention, the surfaces of the workpiece are either mechanically pretreated or partially sealed using a flash microwave heating technique prior to the heating step.

The process of the present invention may be used to pneumatically isostatically forge powdered materials and castings.

In yet another alternative of the method of the present invention, the workpiece is transferred from a heating apparatus used to perform the heating step to the pressure vessel via a thermal baffle so as to minimize the loss of heat during the transfer step.

Other details of the method of the present invention, as well as other advantages and objects attendant thereto, are set forth in the following detailed description and the accompanying drawings in which like reference numerals depict like elements.

DETAILED DESCRIPTION OF THE PREFERRED EMBODIMENT(S)

The process of the present invention has the goal of consolidating materials so as to form near net shape products. The process, known as pneumatic isostatic forging (PIF), utilizes high strain rate (plastic) deformation of the material forming the workpiece as the mechanism of consolidation or densification. As used herein, the term high strain rate means a strain rate in the range of from about 10% to about 20% produced over a time in the range of from about 1 second to about 120 seconds, and most preferably over a time in the range of from about 1 second to about 20 seconds. The process utilizes a gaseous medium to generate triaxial compaction forces of substantially equal magnitude which are then applied to the workpiece to thereby substantially uniformly consolidate it. A pneumatic or gas pressure force permits excellent control of the rate of pressurization and therefore, the speed of deformation of the material. The use of a gas medium also provides a reliable, non-mechanical touching of the workpiece to provide final shaping. Additionally, a gas pressing medium such as argon remains stable at temperatures in excess of 2000° C. The underlying principle of the present invention is to rapidly collapse the surface of the material in such a manner as not to lose the differential driving force as a result of gas absorption.

In comparison to standard HIP processes, the pneumatic isostatic forging process 10 of the present invention provides rapid input and output when processing a workpiece 22. The process 10 utilizes heat from a previous processing step 14, 14' in which the workpiece has been heated to reduce cycle time.

Figure 1:
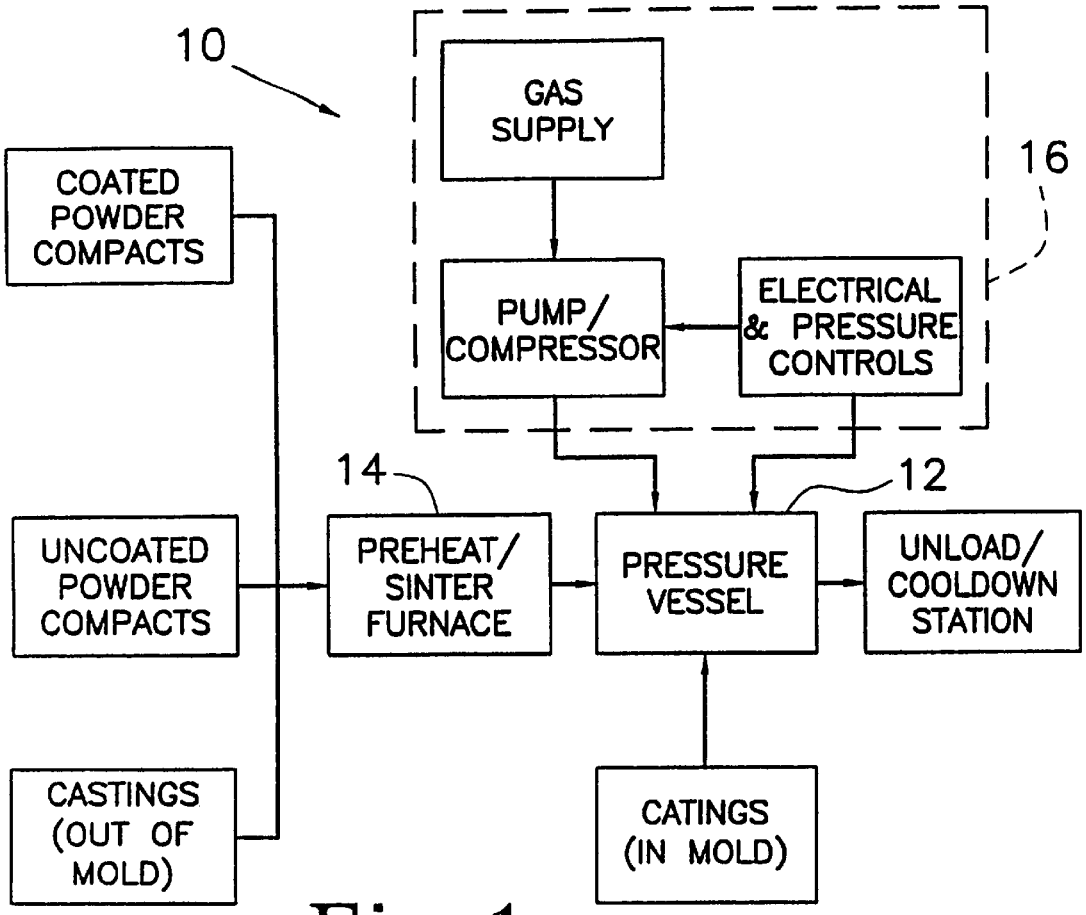
FIG. 1 is a flow diagram of the pneumatic isostatic forging method of the present invention.

A flow diagram depicting a general overview of the PIF process is shown in FIG. 1. As shown therein, the workpieces 22 to be forged may include coated powder compacts, uncoated powder compacts, and castings. In the PIF process, the workpieces 22 to be forged are heated externally of a pressure vessel 12 where the forging operation is to take place. For powder metallurgy products, the source of heat may be a pre-sinter, debinder, or high temperature coating furnace 14. For castings, the source of heat may be a casting furnace (not shown) such as one utilized during the healing of defects. The pressure vessel 12 has a pressurizer 16 including a pump compressor (not shown) for pressurizing the pressure vessel with a gas. The pressure within the pressure vessel 12 may be variably controlled.

The pressure vessel 12 is preferably constructed to withstand pressures of at least about 60,000 psi. A pumping system capable of generating pressures up to at least about 60,000 psi within about 8 to about 30 seconds has particular utility in the process of the present invention. It should be noted however that the present invention is not limited to these specifications as it is foreseeable that materials other than those mentioned herein will perform more efficiently at higher or lower pressures.

In a preferred embodiment, the pressure vessel 12 has a chamber 20 which is configured such that the workpiece 22 and any fixture(s) (not shown) associated therewith occupy approximately eighty to ninety percent (80%–90%) of the volume therein. As a result, temperature and pressure requirements are reduced. Most effected is the temperature requirement in that minimal surrounding gas is heated by the workpiece 22. Thus, the workpiece 22 is better able to retain its temperature and a more efficient process is obtained.

In the process of the present invention, the workpiece 22 is heated by the heating means external to the pressure vessel 12 to a temperature at which the flow stress requirement of the material forming the workpiece is reduced below the level of stress to be generated by the forging gas medium. The temperature to which the workpiece is heated in the external heating means should be such that the workpiece can be transferred, while in a heated condition, to the pressure vessel 12 and still have a residual temperature adequate to keep the flow stress below the driving stress of the gaseous medium until consolidation is achieved. During heating, the workpiece is held at the desired temperature for a time sufficient to heat fully through the workpiece, thermally stabilize the workpiece, and achieve thermal equilibrium. Obviously, the desired temperature will vary for each different material. Typical temperatures include 525° C. for aluminum, 900° C. for copper, and 1225° C. for iron.

Figure 2:
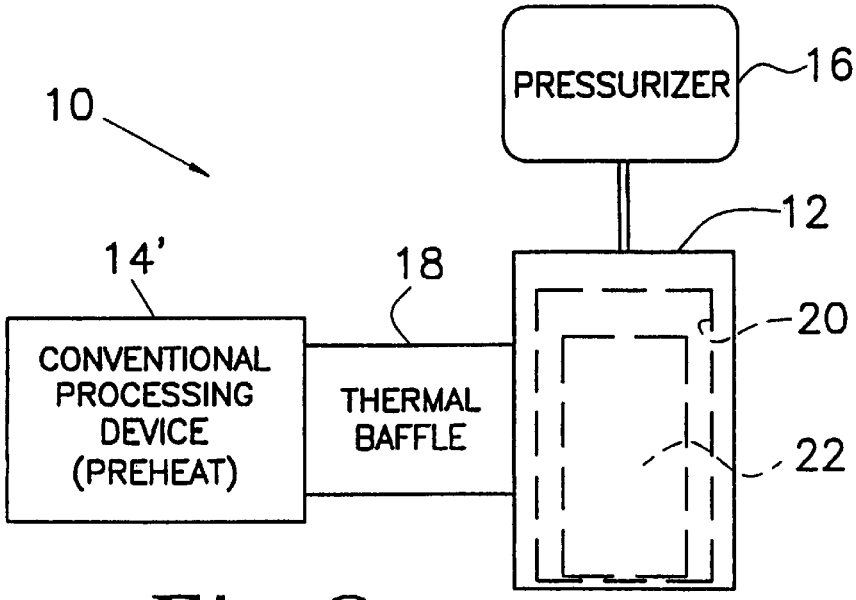
FIG. 2 is a schematic diagram illustrating the transfer of the workpiece from a conventional manufacturing process through a thermal baffle to a pressure vessel chamber.

As previously mentioned, after the workpiece has been heated, it is transferred to a pressure vessel chamber 20. In certain situations, it may be desirable to transfer the heated workpiece 22 to the chamber 20 via a thermal baffle 18 as shown in FIG. 2.

Within the pressure vessel chamber 20, the heated workpiece is subjected to a pneumatic gas pressure force having a target pressure in the range of from about 10,000 psi to about 60,000 psi. While resident in the pressure vessel chamber 20, the workpiece 22 is not subjected to any application of heat, thus distinguishing the process of the present invention from hot isostatic processes.

As previously mentioned, the mechanism for consolidating or densifying the workpiece 22 is the production of a high strain rate in the material which results in plastic deformation thereof. The high strain rate is accomplished by rapid pressurization of the workpiece to pressure levels as high as 60,000 psi. In a preferred embodiment of the present invention, pressure is applied to the surfaces of the workpiece 22 via a gaseous medium such as nitrogen, argon, and mixtures thereof. It has been found that rapid pressurization of the gaseous medium densifies it in such a manner that there is limited absorption of the gas by the workpiece. As a result, there is a net pressure force acting on the exterior surface(s) of the workpiece which consolidates the material forming the workpiece.

It has been found that pressure ramp rates ranging from about 300 to about 4000 psi/sec are useful in performing the process of the present invention. A typical HIP process, on the other hand, utilizes an average pressure rate of 5 to 8 psi/sec. It is also desirable to reach the target pressure for the material being processed within about 15 seconds from the time gas flow begins. A particularly useful pressure ramp rate range has been found to be from about 300 psi/sec to about 1500 psi/sec. A most preferred pressure ramp rate is in the range of from about 300 psi/sec. to about 1200 psi/sec.

In one embodiment of the present invention, the pressure ramp rate is accomplished by a combination of an initial pressure pulse resulting from initialization of the gas pumping system and a steep acceleration of pressure to a designated pressure level. The pressure rate curve during the acceleration of pressure phase is preferably in uniform segments, i.e. piecewise linear increasing from about 600 psi/sec to about 750 psi/sec. Once the pressure in the chamber 20 reaches a desired level, it is maintained for a time period, typically from about 10 seconds to about 120 seconds. During this period, the applied pressure creates a strain rate in the material which plastically deforms the material by overriding its flow stress requirements.

It is desirable during the initial pressure pulse phase that pressures of about 20,000 psi be reached within about 25 to 30 seconds, or in other words, the pressure ramp rate be in the range of from about 650 psi/sec to about 800 psi/sec. At a pressure ramp rate in this range, the gas densifies and becomes less absorptive. After the initial pressure has been reached, the pressure in the vessel may be raised to a pressure in the range of from about 20,000 psi to about 60,000 psi.

One approach which may be utilized to achieve rapid pressurization is to provide an accumulator to assist the pumping process. When the chamber 20 is pressurized, the pressure quickly rises to an offset condition with that of the gas storage system. Supplemental storage could be coupled as an accumulator that could be used to provide an additional pressure pulse at the beginning of the cycle. This would accelerate pressurization of the system, especially in terms of reaching 20,000 psi rapidly.

While lower pressures may be utilized, a preferred target pressure range for the process of the present invention is from about 45,000 psi to about 60,000 psi. After the workpiece 22 has been held at the target pressure for about 10 to about 120 seconds, the pressure is relaxed. Preferably, the pressure is relaxed within about 10 to about 60 seconds. Once consolidated, the workpiece can be cooled under pressure when seeking a specific desired end effect or the workpiece may be removed from the pressure chamber 20 shortly after consolidation and cooled in a supplemental cooling station.

While it is preferred to use a two phase pressure cycle during the forging operation, it is possible to pressurize the vessel 12 in a uniformly ramped manner to the required forging pressure via the pressure controller.

An entire forging cycle involves the steps of (1) loading the workpiece 22 into the pressure vessel 12; (2) establishing a closure seal within the pressure vessel 12; (3) pressurizing the vessel 12 using rapid pressurization; (4) maintaining the pressure within the vessel 12; (5) depressurizing the vessel 12; and (6) unloading the densified workpiece 22. The entire cycle ranges from 1 to 5 minutes and is broken down as follows: step (1): approximately 10–45 seconds; step (2) approximately 15–20 seconds; steps (3) and (4) 10–120 seconds; step (5) 10 seconds; and step (6) approximately 20–30 seconds.

As previously mentioned, the process described herein may utilize the latent heat from a previous processing step so that there is no need for heating the workpiece 22 within the pressure vessel 12. As a result, the useful capacity of the pressure vessel may be maximized. Instances in which latent heat is used include systems where the workpiece 22 is formed from molten material, where the workpiece is hot-rolled, annealed or otherwise heat treated. Conventionally, workpieces 22 that have been heat treated are first cooled before handling to remove excess material, to be shipped, or otherwise handled. However, in the present invention, the heated workpiece is transferred to the pressure vessel in a heated state.

The workpiece 22 is at a homogeneous temperature throughout prior to the application of the isostatic forging pressure, permitting isostatic application of pressure and uniform plastic deformation of the workpiece, thereby permitting the use of temperatures ranging from 50° to 400° C. lower than the temperatures required by other processes. Further, the hold times at the temperature and the high isostatic forging pressures are typically from about 8 to about 30 seconds. This permits microstructural control of the workpiece 22 and uniformity of optimized properties throughout the workpiece.

As previously discussed, the vessel 12 is pressurized using rapid pressurization which provides several benefits. First, rapid pressurization accomplishes a sufficiently high strain rate to assist in the final closure of voids within the workpiece 22. The high strain rate closes the voids so that the gaseous medium does not penetrate into the workpiece and upset the desired pressure differential.

Further, rapid pressurization serves to densify gas within the vessel 12, thereby increasing the viscosity of the gas in order to substantially reduce or altogether prevent absorption of the gas into the workpiece 22. By preventing the gas from being absorbed into the workpiece 22, a differential is maintained between the internal pressure and the surface pressure of the workpiece 22, thereby allowing plastic deformation to take place through a "collapsing" of the material, or removal of the voids. Also, because no heat is introduced into the workpiece 22 after it has been removed from the heating process, rapid pressurization forces heat from the workpiece 22 thereby reducing the cool-down time required before opening the vessel 12 to remove the densified workpiece 22.

When loading the workpiece 22 into the pressure vessel, encapsulation and pressure transfer media are not ordinarily required. Conventionally, both encapsulation and pressure transfer media are required if the workpiece has surface connected porosity. Thin coatings and pre-treatment processes may be used to avoid encapsulation requirements. A variety of coatings have been developed for different materials and can be applied as metallic, organic, oxide and combination coatings. The combination of rapid processing and coating developments permit densification and defect healing that could not be accomplished by longer cycles or with workpieces 22 heated from the outside toward the center where the coatings may diffuse extensively into the workpiece 22 or fail during heating and pressurization due to thermal expansion mismatch.

As needed, two different types of coating procedures are used. Batch coatings are applied to lots of components in a separate operation prior to being partially sintered in the preheat furnace before densification by the present method. These coatings are thin metal coatings, such as nickel, applied in thicknesses of 0.001 inches or less, by an electroless nickel coating process or other conventional plating process. Other thin metal coatings of iron, chromium, titanium, copper, alloys of these metals, and mixtures thereof, and coatings of metal oxides may be applied by physical vapor deposition, chemical vapor deposition, or plasma spraying. Coatings such as oxide coatings may be applied in situ by a steam oxidation treatment, or by spray or dip coating, using zirconium oxide-based proprietary coatings. The in situ coatings may be applied on workpieces 22 as they are being fed to the sintering/preheat furnace 14. The coatings may be applied at temperatures of up to about 980° C. during the pre-treatment of parts for pneumatic isostatic forging. Alternatively, the workpiece may be partially or completely wrapped in metal foil prior to heating.

Mechanical pre-treatment processes, including grit and shot blasting, may be used to reduce surface connected pore sizes prior to the heat treatment. Surfaces of the workpiece also may be treated by flash microwave heating to partially seal the surface pores prior to heat processing.

Encapsulation is utilized when forging loose powder or low density "green" parts. However, neither pressure transfer media nor forging dies are required when forging with a very dense fluid, such as argon or nitrogen. The lack of any need for forging dies is particularly advantageous because forging dies degrade and are costly to replace.

The pneumatic isostatic forging process 10 of the present invention may be utilized to densify many materials including copper, nickel, chromium, steel, titanium and aluminum alloys and metal matrix composites. The process 10 of the present invention may also be used to achieve densification of powdered metal materials, either as a pre-form or as an encapsulated, freestanding powder. The powdered metal material may be pressed to a near net shape workpiece by conventional die pressing, cold isostatic pressing or metal injection molding before being subjected to the process of the present invention. Further, the process 10 may be utilized to heal casting defects in aluminum, titanium, nickel, and steel alloy, and polymer and polymer composites. It should be noted that the process 10 of the present invention is not limited to the densification and healing of castings of the above materials.

The method 10 of the present invention has been found effective for densifying, for example, spinodal (a family of materials composed of copper, nickel and tin) powdered metal materials to one hundred percent (100%) density using a temperature of 1625° F. and a pressure of 55,000 psi. The pressure was raised from atmospheric pressure to 55,000 psi in 50 seconds. The spinodal material densified using the present method 10 displays small grain size and other desirable mechanical properties.

In laboratory tests using the present process 10, the properties of steel alloys were maximized when the workpiece 22 was subjected to cold densification plus grit blasting of the surface. In these tests, a pre-heat furnace 14 was necessary. The forging temperatures were as follows: alloys of molybdenum, rhenium, and tantalum: 1150°–1200° C.; steel alloys: 900°–1150° C.; titanium alloys: 845°–90020 C. For the alloys of molybdenum, rhenium and tantalum, the pressure in the pressure vessel was raised from atmospheric pressure to a pressure in the range of 55,000 to 60,000 psi in 60 seconds. For the steel and titanium alloys, the pressure in the pressure vessel was raised from atmospheric pressure to 45,000 psi in 45 seconds.

For densification of metal matrix composites, the combination of lower processing temperatures and short cycle times of the forging process 10 of the present invention minimizes or eliminates reaction between the matrix and the re-enforcement addition. This permits the fabrication of composites with enhanced properties.

A particular use for the present invention is in healing casting defects in workpieces 22. The healing process is accomplished typically within several minutes and at lower temperatures, in most cases, than the temperatures required for defect healing by hot isostatic pressing. The pressures required to close the defects are a function of the shear-flow stress properties of the cast alloys at the forging temperatures. Defect healing for aluminum castings has been performed at pressures of 10,000 to 15,000 psi at 520° C., with a hold time of 10 to 20 seconds. The pressure in the pressure vessel was raised from atmospheric pressure to a pressure in the range of 10,000 to 15,000 psi in a time period of from 15 to 20 seconds.

Through testing, titanium alloy casting defects have been healed at a temperature of 845° C. and a pressure of 10,000 psi for 1 to 5 minutes hold time. The pressure in the pressure vessel was raised from atmospheric pressure to 10,000 psi in a time period of 10 to 15 seconds. Nickel alloy casting defects are healed at pressures of 40,000–45,000 psi and 50° C. below the HIP temperature. The pressure in the pressure vessel was raised from atmospheric pressure to a pressure in the range of 40,000 to 45,000 psi in a time period of from 45 to 50 seconds. Steel alloy casting defects are healed at pressures of 30,000–45,000 psi and at a temperature between 100° to 125° C. below the HIP temperature. The pressure in the pressure vessel was raised from atmospheric pressure to a pressure in the range of 30,000 to 45,000 psi in a time period in the range of 30 to 50 seconds. Defect healing time for both the nickel and steel alloys is 10 to 60 seconds.

The energy consumption of the pneumatic isostatic forging device using the process 10 of the present invention is significantly less in comparison to the amount of energy consumed using the hot isostatic processing devices of the prior art. More specifically, the energy costs are one-tenth to one-thousandth of that required by other processes. The energy savings are accomplished through short cycle times, reduced fabrication temperature requirements, use of latent heat from a prior step 14', conservation of heat by transfer of a workpiece 22 through a thermal baffle 18, and hold times as short as less than 10 seconds.

From the foregoing description, it will be recognized by those skilled in the art that a pneumatic, isostatic forging process offering advantages over the prior art has been provided. Specifically, the pneumatic, isostatic forging process of the present invention is performed in-line with other conventional steps in manufacturing to utilize the latent heat from a previous processing step. Further, the process provides a decreased cycle time to process a workpiece. Moreover, the process of the present invention utilizes surface pretreatment for surface connected porosity to avoid use of media and encapsulation. Also, the utilization of forging dies is not required.

While a preferred embodiment has been shown and described, it will be understood that it is not intended to limit the disclosure, but rather it is intended to cover all modifications and alternate methods falling within the spirit and the scope of the invention as defined in the appended claims.

What is claimed is:

1. A method for in-line pneumatic isostatic forging processing of a workpiece comprising the steps of:

processing the workpiece in a conventional manufacturing method wherein the workpiece is heated by a conventional heating device;

removing the workpiece from the conventional heating apparatus;

transferring the workpiece to a pressure vessel chamber;

applying pressure to the workpiece in a uniformly-ramped fashion; and maintaining said pressure for a duration of time.

2. The method of claim 1 wherein:

said processing step heats said workpiece to a temperature at which said workpiece can be forged; and said pressure applying step comprises applying pressure without any application of heat to said workpiece.

3. The method of claim 1 wherein said pressure vessel chamber is configured such that the workpiece occupies a substantial volume thereof.

4. The method of claim 3 wherein said substantial volume of said pressure vessel is at least eighty percent thereof.

5. The method of claim 1 wherein said step of transferring the workpiece to said pressure vessel chamber is performed through a thermal baffle interconnected between the conventional process and said pressure vessel chamber such that heat loss during said step of transferring the workpiece is minimized.

6. A method for in-line pneumatic isostatic forging processing of a workpiece comprising the steps of:

processing the workpiece in a conventional manufacturing method wherein the workpiece is heated by a conventional heating device;

removing the workpiece from the conventional heating device;

transferring the workpiece to a pressure vessel chamber, said step of transferring the workpiece to said pressure vessel chamber is performed through a thermal baffle interconnected between the conventional heating device and said pressure vessel chamber such that heat loss during said step of transferring the workpiece is minimized;

applying pressure to the workpiece in a uniformly-ramped fashion;

maintaining said pressure for a duration of time;

releasing said pressure; and removing the workpiece from said pressure vessel.

7. The method of claim 6 wherein said pressure applying step comprises applying said pressure without any application of heat to said workpiece while said workpiece in said pressure vessel.

8. The method of claim 7 wherein said pressure vessel chamber is configured such that the workpiece occupies a substantial volume thereof.

9. The method of claim 8 wherein said substantial volume of said pressure vessel is at least eighty percent thereof.

10. A method for pneumatic isostatic forging processing of a workpiece comprising the steps of:

heating the workpiece in a conventional heating device;

removing the workpiece from the conventional heating apparatus;

transferring the workpiece to a pressure vessel chamber;

applying pressure to the workpiece in a uniformly-ramped fashion; and maintaining said pressure for a duration of time.

11. The method of claim 10 wherein said pressure applying step comprises applying said pressure to the workpiece without any application of heat to said workpiece while said workpiece is present in said pressure vessel chamber and applying said pressure at a rate sufficient to close voids in surfaces of said workpiece by plastic deformation and not by creep.

12. The method of claim 10 wherein said pressure vessel chamber is configured such that the workpiece occupies a substantial volume thereof.

13. The method of claim 12 wherein said substantial volume of said pressure vessel chamber is at least eighty percent thereof.

14. The method of claim 10 wherein said step of transferring the workpiece to said pressure vessel chamber is performed through a thermal baffle interconnected between the conventional heating device and said pressure vessel chamber such that heat loss during said step of transferring the workpiece is minimized.

15. A method for densifying a workpiece so as to produce a near net shape final product comprising the steps of:

providing a workpiece and a pressure vessel for processing said workpiece;

heating said workpiece externally of said pressure vessel to a temperature at which said workpiece can be forged;

transferring said workpiece to said pressure vessel while at said temperature; and applying pressure to said workpiece without any further application of heat and at a rate sufficient to close voids in said workpiece by plastic deformation.

16. The method of claim 15 wherein said pressure applying step comprises introducing a fluid medium under pressure into said pressure vessel so that said fluid medium contacts the surfaces of said workpiece and forges same.

17. The method of claim 16 wherein said fluid medium introducing step comprises introducing a gas selected from the group consisting of argon, nitrogen and mixtures thereof into said pressure vessel.

18. The method of claim 15 further comprising:

maintaining said pressure within said pressure vessel; and said pressure being applied and maintained for a time period in the range of about 10 to about 120 seconds.

19. The method of claim 15 wherein said pressure applying step comprises applying a pressure in the range of from about 10,000 psi to about 60,000 psi.

20. The method of claim 15 further comprising:

applying a coating to surfaces of said workpiece prior to said heating step.

21. The method of claim 20 wherein said coating applying step comprises applying a nickel coating having a thickness equal to or less than 0.001 inches to said surfaces.

22. The method of claim 21 wherein said nickel coating is applied using an electroless nickel coating process or a plating process.

23. The method of claim 20 wherein said coating applying step comprises applying a coating selected from the group consisting of iron, chromium, titanium, copper, and mixtures thereof.

24. The method of claim 23 wherein said coating is applied using a physical vapor deposition, a chemical vapor deposition or plasma spraying process.

25. The method of claim 20 wherein said coating applying step comprises applying a metal oxide coating to said surfaces of said workpiece.

26. The method of claim 15 further comprising mechanically pretreating said surfaces of said workpiece to reduce surface connected pore sizes prior to said heating step.

27. The method of claim 15 further comprising partially sealing surface pores in said workpiece prior to heating.

28. The method of claim 27 wherein said partially sealing step comprises partially sealing said surface pores using flash microwave heating.

29. The method of claim 15 wherein:

said workpiece providing step comprises providing a compact of powdered materials; and said heating step comprises heating said compact in at least one of a pre-sinter, debinder, and high temperature coating furnace.

30. The method of claim 15 wherein:

said workpiece providing step comprises providing a casting; and said heating step comprises using heat from a furnace used to form said casting.

31. The method of claim 15 further comprising:

releasing said pressure within said pressure vessel; and removing said workpiece from said pressure vessel.

32. A method for forming a forged, near net shape product comprising the steps of:

providing a workpiece to be forged;

heating said workpiece to a temperature sufficient to reduce the flow stress requirement of the material forming the workpiece and stabilizing said workpiece at said temperature;

transferring said workpiece to a pressure vessel chamber; and rapidly applying pressure to said workpiece at a pressure rate sufficient to plastically deform the workpiece by overriding the flow stress requirements of the material and without any application of heat.

33. The method of claim 32 wherein said pressure applying step comprises introducing a gaseous medium into the pressure vessel chamber at a rate in the range of from about 300 psi/sec to about 4000 psi/sec.

34. The method of claim 32 wherein said pressure applying step comprises initially introducing a gaseous medium into the pressure vessel chamber at a rate of about 650 psi/sec to about 800 psi/sec until the pressure in said pressure vessel chamber reaches a pressure of about 20,000 psi and thereafter raising said pressure to an end pressure in the range of from about 20,000 psi to about 60,000 psi.

35. The method of claim 34 wherein said end pressure is maintained for period in the range of from about 10 seconds to about 120 seconds.

36. The method of claim 34 wherein said end pressure is in the range of from about 45,000 psi to about 60,000 psi.

37. The method of claim 32 wherein said heating step further comprises heating said workpiece to a temperature that is sufficiently above said temperature sufficient to reduce the flow stress requirement of the material to accommodate any temperature loss during said transferring step.

38. The method of claim 32 wherein said pressure applying step comprises introducing a gaseous medium into said pressure vessel chamber so that triaxial compaction forces of substantially equal magnitude are applied to said workpiece, thereby substantially uniformly consolidating said workpiece.

39. The method of claim 32 wherein said pressure applying step comprises introducing argon into said pressure vessel chamber at a rate which densifies said argon such that it is not significantly absorbed by said workpiece.

40. The method of claim 32 further comprising plastically deforming said workpiece during said pressure applying step by overriding the flow stress requirements of said material forming said workpiece for a time period in the range of from about 10 seconds to about 120 seconds.

41. The method of claim 32 further comprising coating the surfaces of said workpieces prior to said heating step.

42. The method of claim 32 further comprising encapsulating the workpiece prior to said heating step so as to substantially eliminate gas absorption during the pressure applying step.

43. The method of claim 32 further comprising wrapping said workpiece in foil prior to said heating step.

44. The method of claim 32 further comprising subjecting said workpiece to a sintering process prior to said heating step so as to improve the surface properties of said workpiece.

45. The method of claim 32 wherein said workpiece providing step comprises providing a powdered metallic material pressed to a near net shape workpiece by at least one of conventional die pressing, cold isostatic pressing, and metal injection molding.

46. The method of claim 45 further comprising sintering said powdered metallic material prior to said heating step.

47. The method of claim 32 further comprising relaxing said applied pressure within a time period in the range of from about 10 seconds to about 60 seconds.

48. The method of claim 32 wherein said heating step comprises holding said workpiece at said temperature for a time sufficient to heat fully through said workpiece and achieve thermal equilibrium.

49. The method of claim 32 wherein said pressure applying step comprises applying said pressure at a rate which reaches a target pressure within about 15 seconds.

* * * * *